US006053660A

United States Patent [19]

Allen et al.

[11] Patent Number: 6,053,660

[45] Date of Patent: Apr. 25, 2000

[54] HYDRAULICALLY CONTROLLED TWIN ROTOR RIDING TROWEL

[75] Inventors: J. Dewayne Allen, Paragould, Ark.; Michael W. McKean, Arlington, Tenn.

[73] Assignee: Allen Engineering Corporation, Paragould, Ark.

[21] Appl. No.: 09/052,571

[22] Filed: Mar. 31, 1998

Related U.S. Application Data

[63] Continuation-in-part of application No. 08/784,244, Jan. 15, 1997, Pat. No. 5,890,833.

[51] Int. Cl.[7] ..... E01C 19/22

[52] U.S. Cl. ..... 404/112; 451/353

[58] Field of Search ..... 404/112; 451/353

[56] References Cited

U.S. PATENT DOCUMENTS

| | | | |
|---|---|---|---|
| 3,412,657 | 11/1968 | Colizza | 94/45 |
| 3,936,212 | 2/1976 | Holz | 404/112 |
| 4,046,484 | 9/1977 | Holz | 404/112 |
| 5,108,220 | 4/1992 | Allen et al. | 404/112 |
| 5,480,258 | 1/1996 | Allen | 404/112 |
| 5,816,739 | 10/1998 | Allen | 404/112 |

*Primary Examiner*—Eileen Dunn Lillis
*Assistant Examiner*—Raymond W. Addie
*Attorney, Agent, or Firm*—Stephen D. Carver

[57] ABSTRACT

A high performance, twin rotor riding trowel for finishing concrete and hydraulic circuitry therefor, enabling complete joystick control to the operator. The rigid trowel frame mounts two spaced-apart, downwardly-projecting, bladed rotor assemblies that frictionally engage the concrete surface. The rotor assembly blades finish the surface while supporting the trowel. The rotor assemblies are tilted with double acting, hydraulic cylinders to effectuate steering and control. Double acting hydraulic cylinders also control blade pitch. A joystick system enables the operator to hand control the trowel with minimal physical exertion. The joystick system activates electrical circuitry that fires solenoid control valves that in turn energize the various hydraulic cylinders that tilt the rotors and alter blade pitch. The hydraulic control circuitry comprises a motor driven pump delivering pressure to a flow divider circuit. A bypass-valve in line before the flow divider enables an operator to customize the trowel steering characteristics.

26 Claims, 7 Drawing Sheets

HYDRAULICALLY CONTROLLED TWIN ROTOR RIDING TROWEL

CROSS-REFERENCE TO RELATED APPLICATION

This application is a continuation in part of our prior U.S. application, Ser. No. 08/784,244, Filed Jan. 15, 1997, and entitled Hydraulically Controlled Riding Trowel now U.S. Pat. No. 5,890,833, issued Apr. 6, 1999.

BACKGROUND OF THE INVENTION

1. Field of the Invention

This invention relates generally to motorized riding trowels for finishing concrete surfaces of the type classified in United States Patent Class 404, Subclass 112. More particularly, our invention relates to twin-rotor riding trowels comprising joystick-activated, fluid operated systems for controlling steering and blade pitch.

2. Description of the Prior Art

It is well established in the art that freshly placed concrete must be appropriately finished to achieve the desired smoothness and flatness. Motorized riding trowels are particularly effective for finishing concrete. They can finish large surface areas of wet concrete more efficiently than older "walk behind" trowels. Significant savings are experienced by the contractor using such equipment, as time constraints and labor expenses are reduced.

Typical motorized riding trowels employ multiple, downwardly projecting rotors. The rotors contact the concrete surface for finishing concrete and support the weight of the trowel. Typically, each rotor comprises a plurality of radially spaced apart finishing blades that revolve in frictional contact with the concrete surface. The blades may be coupled to circular finishing pans for treating green concrete. The rotors and their revolving blades are responsible for steering and propulsion. To effectiate steering the rotors are tilted to generate differential forces.

As freshly poured concrete "sets", it soon becomes hard enough to support the weight of motorized trowels. Preferably, the finishing process starts with panning while the concrete is still "green", within one to several hours after pouring depending upon the concrete mixture involved. The advent of more stringent concrete surface finish specifications using "F" numbers to specify flatness (ff) and levelness (fl), dictates the use of pans on a widespread basis. Both "super-flat" and "super-smooth" floors can be achieved by panning with motorized trowels.

Pan finishing is normally followed by medium speed blade finishing, after the pans are removed from the rotors. A developing technique is the use of "combo blades" during the intermediate "fuzz stage" as the concrete continues to harden. So-called "combo-blades" are a compromise between pans and normal finishing blades. They present more surface area to the concrete than normal finishing blades, and attack at a less acute angle. The rotors are preferably turned between 100 to 135 RPM at this time. Finishing blades are then used, and they are rotated between 120 to 150 RPM. Finally, the pitch of the blades is changed to a relatively high contact angle, and burnishing begins. This final trowel finishing stage uses rotor speeds of between 135 and 165 RPM.

Motorized riding trowels are ideal for finishing large areas of plastic concrete quickly and efficiently, and a variety of self propelled riding trowels are known in the art.

Holz, in U.S. Pat. No. 4,046,484 shows a pioneer, twin rotor, self-propelled riding trowel wherein the rotors are tilted to generate steering forces. U.S. Pat. No. 3,936,212, also issued to Holz, shows a three rotor riding trowel powered by a single motor. Although the designs depicted in the latter two Holz patents were pioneers in the riding trowel arts, the devices were difficult to steer and control.

Prior U.S. Pat. No. 5,108, 220 owned by Allen Engineering Corporation, the same assignee as in this case, relates to an improved, fast steering system for riding trowels. Its steering system enhances riding trowel maneuverability and control. The latter fast steering riding trowel is also the subject of U.S. Des. Pat. No. 323,510 owned by Allen Engineering Corporation.

U.S. Pat. No. 5,613,801, issued Mar. 25, 1997 to Allen Engineering Corporation discloses a power-riding trowel equipped with separate motors for each rotor. Steering is accomplished with structure similar to that depicted in U.S. Pat. No. 5,108, 220 previously discussed.

Allen Engineering Corporation Pat. No. 5,480,258 discloses a multiple engine riding trowel. The twin rotor design depicted therein associates a separate engine with each rotor. As the engines are disposed directly over each revolving rotor assembly, horsepower is more efficiently transferred to the revolving blades. Besides resulting in a faster and more efficient trowel, the design is easier to steer. Again, manually activated steering linkages are used.

Allen Engineering Corporation Pat. No. No. 5,685,667 discloses a twin engine riding trowel using "contra rotation." Many trowel users prefer the steering characteristics that result when the trowel rotors are forced to rotate in a direction opposite from that normally expected in the art.

Modem large, high power riding trowels are noted for their speed, horsepower, and efficiency. To be effective they must be highly maneuverable and easy to operate. The steering must be fast and responsive. The trowel must be capable of operation over a variety of engine speeds. Further, all of the foregoing characteristics must be preserved whether the trowel is finishing with pans, combo-blades, or normal finishing blades of a variety of sizes. Generally speaking, the more powerful the trowel, the faster finishing operations can be completed. However, with more power it becomes harder to control and properly steer the machine. Crisp, responsive handling is important to optimize the efficiency of the troweling process, and to preserve operator safety and comfort.

The rotors in many of the previously discussed patents are tilted with manually operated levers that project upwardly from the machine frame. The operator manually controls the levers to deflect linkages below the trowel frame that tilt the rotors. Often a vigorous physical effort is required. Where separate engines are used with each rotor assembly, additional physical effort is required to tilt the rotors for steering, or to vary blade pitch. It is clear that to meet all of the demands placed upon the modern riding trowel, a powered steering system must be perfected.

Hence we have designed a twin rotor riding trowel with an optimized steering control system. Our hydraulic steering and blade pitch control system is optimized for dual-rotor trowels. Our system can be adjusted to readily adapt itself for use with finishing pans, combo blades, or normal blades. Further, it readily adapts itself to drivers of different weight. Handling characteristics can be somewhat customized to approximate the desired "feel" of the individual driver.

SUMMARY OF THE INVENTION

Our new twin-rotor riding trowel maximizes operator control. The preferred trowel comprises a pair of spaced apart rotors gimbaled to the frame. The bladed rotors contact the concrete surface and rotate simultaneously. The trowel may comprise either one or two engines to power the dual rotors. Joysticks, conveniently placed near the operator, activate suitable hydraulic components that tilt the rotors to steer and control the trowel and change blade pitch. With our joystick system the old, cumbersome manually operated control levers are omitted.

Thus our dual-rotor riding trowel is fully "powered" for automatic control. Hydraulic circuitry facilitates steering and propulsion by tilting the rotors; concurrently the system remotely varies and controls blade pitch. Preferably joystick controls are interconnected through appropriate circuitry to activate the hydraulics. Hydraulic pressure is obtained from a suitable pump driven by the trowel motor(s). Trowels may be equipped with either one or two internal combustion engines powered by gasoline, diesel fuel, or gas. As a result, the operator can steer the device with a minimum of physical effort Thus a fundamental object of the invention is provide a powered control system for dual rotor riding trowels.

Another fundamental object is to hydraulically provide power steering and power blade pitch control in dual-rotor riding trowels.

A further object is to provide an electrical-over-hydraulic steering and control system for riding trowels that is lever or joystick controlled.

Another important object is to simplify the operation of high power, dual rotor trowels.

A related object is to reduce the physical effort required to safely drive a twin-rotor riding trowel.

Another basic object is to provide a power steering system for a high speed trowel that quickly and efficiently delivers its considerable horsepower to multiple rotor assemblies.

It is also an object to provide power steering for twin-engine riding trowels that works efficiently while running either conventional blades, combo-blades, or finishing pans.

A still further object is to provide a hydraulic control circuit of the character described that will function on a variety of riding trowels, including diesel or gasoline powered trowels with either one or two motors.

Another important object is to provide a high power riding trowel that overcomes power-draining vacuum effects that occur when panning wet concrete.

Another fundamental object is to independently, hydraulically control each of the rotors in a twin-rotor trowel.

A related object is to provide an electrical control system for actuating the hydraulic system in a twin-rotor trowel. It is a feature of this invention that "joystick steering" is employed for ultimate trowel ride control in conjunction with the hydraulics.

Another basic object is to provide a power steering system for twin rotor riding trowels that works with either standard rotation or contra rotation.

Yet another important object is to provide a power steering equipped riding trowel wherein the rotors flatten the concrete surface sufficiently to attain the high "F-numbers" (i.e., flatness characteristics) that are established by certain ACI regulations.

Another object of the present invention is to provide a trowel of the character described that is inherently stable and easy to control and steer.

A related object is to provide a twin-engine riding trowel that is ideal for quick curing concrete jobs.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and are to be contained in conjunction therewith, and in which like reference numerals have been employed throughout in the various views wherever possible.

DETAILED DESCRIPTION

Figure 1:
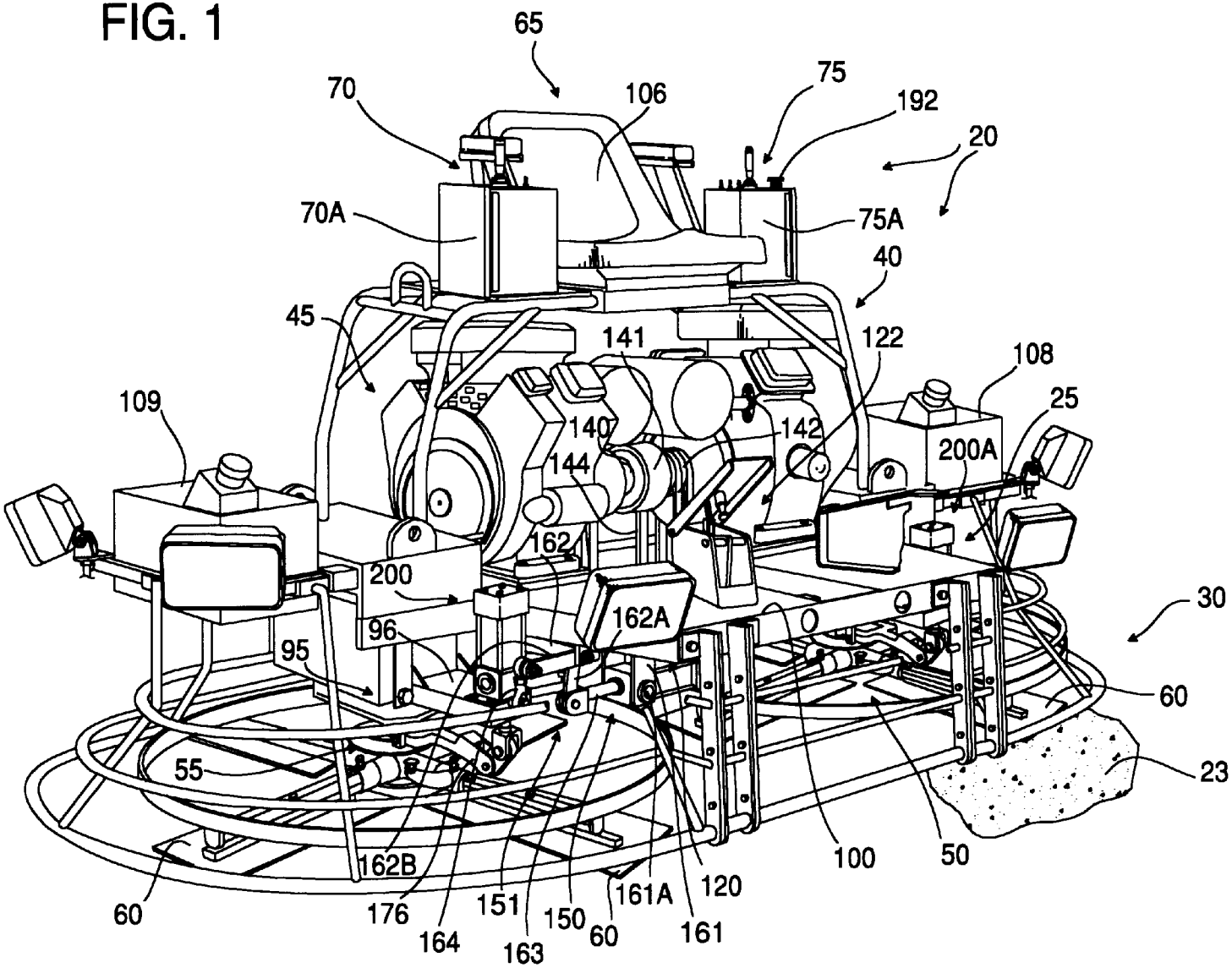
FIG. 1 is a frontal isometric view of our new twin-rotor riding trowel showing the best mode of our hydraulic steering system.

With initial reference now directed to FIGS. 1–4 of the accompanying drawings, a twin rotor riding trowel is broadly designated by the reference numeral 20. Substantial structural details twin rotor riding trowels are set forth in prior U.S. Pat. Nos. 5,108,220, 5,613,801, 5,480,257, and 5,685,667 which, for disclosure purposes, are hereby incorporated by reference herein.

Riding trowel 20 comprises a metal frame 25 surrounded by a guard cage 30 (FIGS. 1–3) surrounding its periphery. A pair of spaced apart rotor assemblies 50, 55 are gimbaled to the frame and project downwardly into contact with concrete surface 23. Several radially spaced apart blades 60 extend outwardly from each of the rotors 50, 55. The blades 60 frictionally contact the concrete surface 23 to be finished and support the trowel 20 and the operator. An operator station 65 mounts on the top of the frame. As illustrated, frame 25 mounts a pair of displaceable engines 40, 45 that drive the counter-rotating, rotor assemblies 50, 55 as described in U.S. Pat. No. 5,685,667. However, it will be appreciated that the instant invention is of equal utility in conjunction with single engine riding trowels, with either normal or contra rotation, and with gasoline, diesel powered, or alternative engines.

Figure 2:
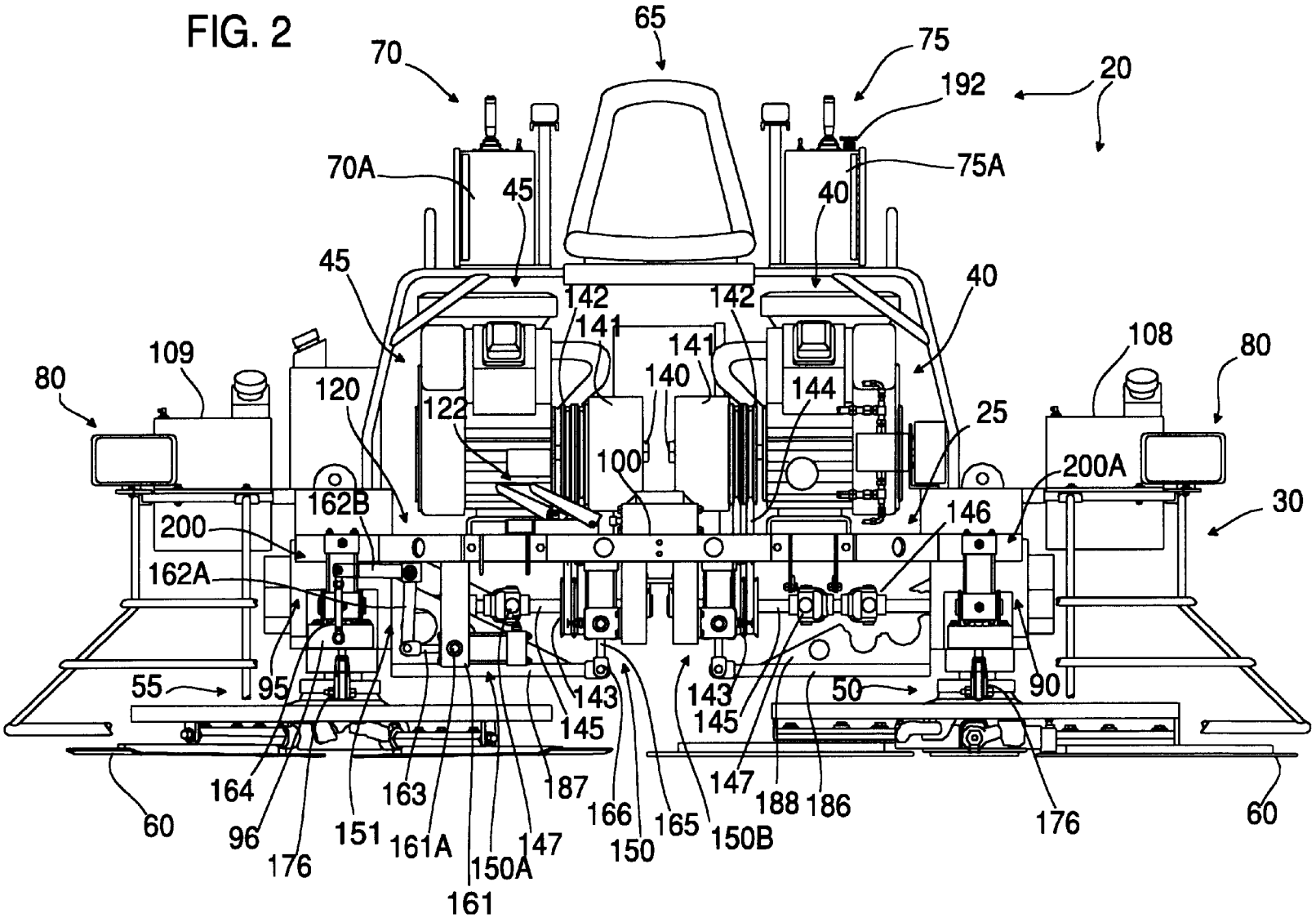
FIG. 2 is a partially fragmentary, front elevational view with portions omitted for simplicity and/or broken away for clarity.
Figure 3:
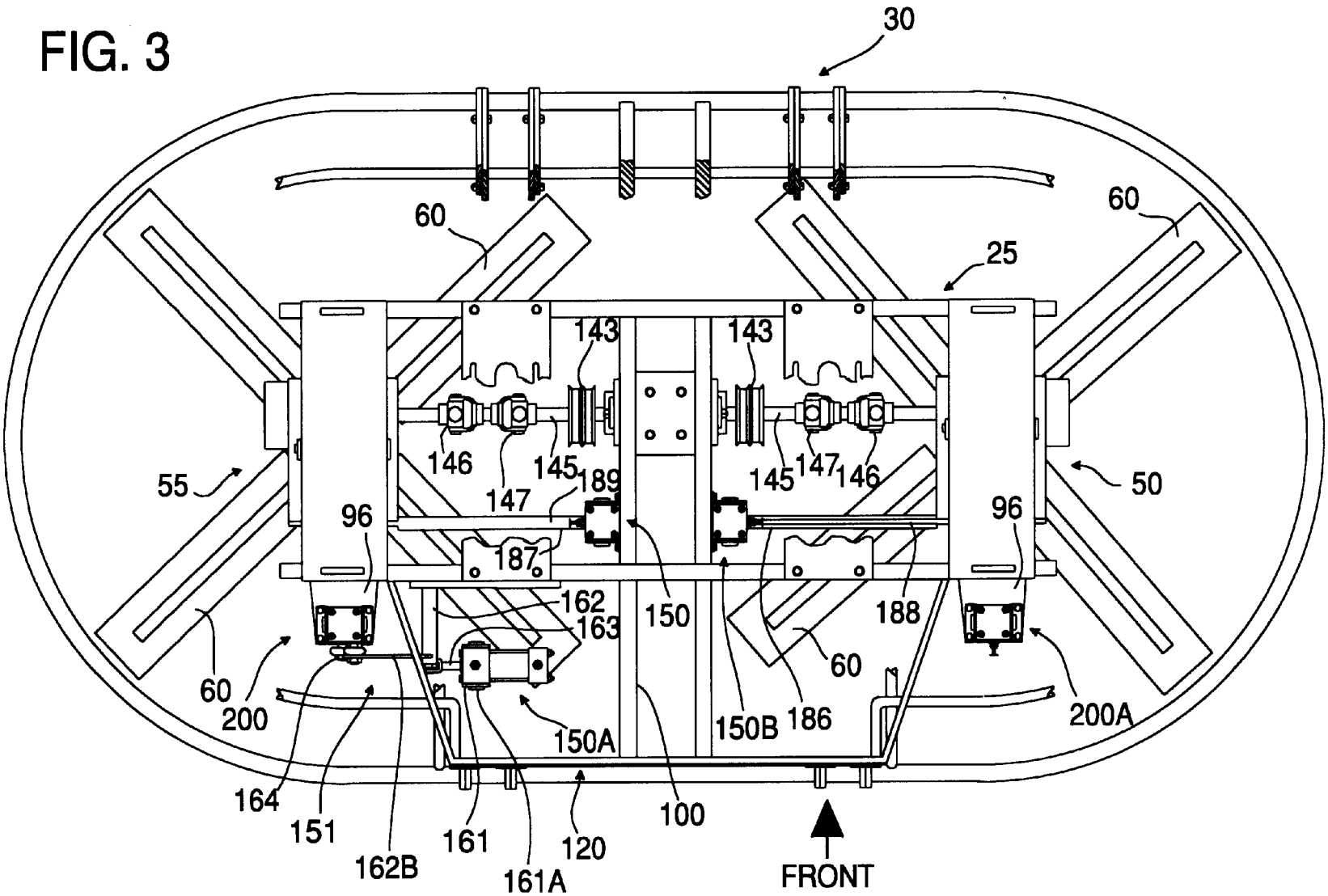
FIG. 3 is a fragmentary, top plan view with portions thereof broken away or shown in section for clarity.

The controls are easily reached by a seated operator at station 65. The operator steers trowel 20 with joysticks 70, 75 (FIG. 1). Left joystick 75 and right joystick 70 (i.e., from the point of view of a seated operator) are secured to control housings 75A and 70A respectively. As described later, left joystick 75 operates an intermediate actuator means for controlling the hydraulic steering tilting circuitry, which in the best mode comprises an electric circuit 400 seen in FIG. 7. Similarly, right joystick 70 operates an intermediate actuator means for controlling steering hydraulic tilting circuitry, which in the best mode comprises the electric circuit 300 of FIG. 6. Joystick 70 can be pushed forwardly or pulled rearwardly, and it may also be moved to the operator's left and right. Left joystick 75 only moves forwards or backwards. Left joystick 75 operates electrical circuit 400 (FIG. 7) and the right joystick 70 operates circuit 300 (FIG. 6) that will be described hereinafter. Circuits 300, 400 operate a hydraulic system 220 to be described in conjunction with FIG. 5 that tilts the rotors or operates the blade pitch forks 176 (FIG. 1) to control the machine. The gearboxes 90, 95 control the angle or degree of tilt of the rotors 50, 55 to generate steering forces. They are mounted to the frame in the manner taught in the aforementioned patents. The longitudinal pitch of each blade 60 may also be manipulated, either manually or electrically, to further control the trowel 20 and the finish imparted to the concrete surface 23 (FIGS. 1 and 2).

The frame 25 comprises an upper deck 100 that provides a mounting surface and a seat 106 to permit the operator to ride the trowel. Conventional engine controls and gauges (not shown) are conveniently mounted adjacent the seat 106 within or upon housings 70A, 75A. Two gas tanks 108 and 109 are mounted on opposite frame ends. A forward subframe 120 projecting from the frame 25 mounts a throttle pedal 122. The throttle peddle 122 controls the flow of fuel from the gas tanks 108, 109 to the engines 40, 45 to ensure that the rotors 50, 55 (FIGS. 1,2) rotate substantially uniformly.

Figure 4:
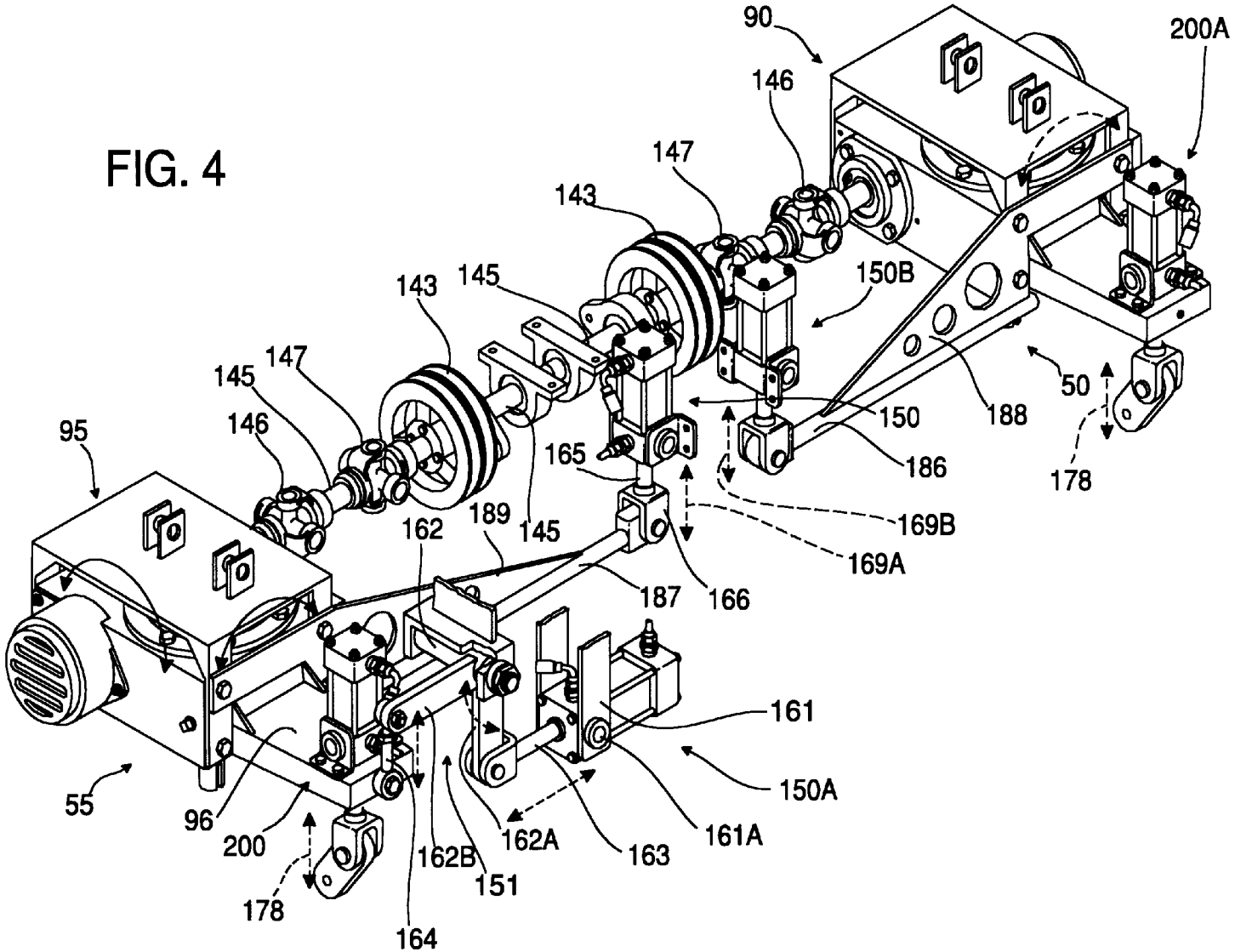
FIG. 4 is an enlarged, fragmentary exploded view of the drivetrain and associated hydraulic controls.

The drivetrain of FIG. 4 has been discussed in detail in the aforementioned patents. Its purpose is to drive the gearboxes to rotate the rotors in response to the motors. An output shaft 140 (FIG. 2) of an engine 45 drives a clutch 141 controlling a pulley 142 (FIG. 2). The fan belts 144 entrained about pulley 142 and 143 rotate driveshaft 145 (FIG. 4). Belts 144 can slip to prevent engine damage. The belts 144 also permit the engine 45 to be displaced slightly forwardly or rearwardly without altering the driveshaft or gearbox positions. Driveshaft 145 extends into a rotor gearbox 90 or 95 (FIG. 4) through a U-joints 146, 147. The driveshaft axes of rotation are generally parallel to the engine axes of rotation. U-joints 146, 147 allow slight, operational displacements of the gearbox 95 relative to the input shaft pulley 143.

Preferably, gearbox 95 tilts right to left and front to back, whereas gearbox 90 tilts only left to right (i.e., in a plane parallel with the biaxial plane). When deflected by cylinders 150, 150B, the elongated torque rods 186, 187 (FIG. 4) extending from the gearboxes 90, 95 tilt the rotors in a plane parallel with the biaxial plane (i.e., the hypothetical plane established by the axis of rotation of both rotors). The torque rods 186, 187, that function as the preferred levers, are generally aligied and extend along the bottom of gussets 188, 189 projecting from the gearboxes. The rods 186, 187 are also offset from the axis of rotation defined within the steering boxes as disclosed in the above referenced patents. Gearbox 95 can be tilted in a plane perpendicular to the last mentioned plane with hydraulic cylinder 150A that lifts or lowers projection 96 through linkage 151 (FIG. 4).

Cylinder 150A is oriented horizontally for clearance purposes as shown (FIG. 4). It is secured to brace 161 by pivot 161A. Ram 163 terminates in a clevis connected to arm 162A welded to sleeve 162. Cooperating arm 162B emanating from sleeve 162 drives a Heim joint 164 coupled to projection 96. Cylinder 150A moves projection 96 up and down to tilt the right side rotor in a plane perpendicular to the biaxial plane. Alternatively, cylinder 150A could be oriented vertically, obviating the need for linkage 151.

Cylinders 150 and 150B (FIG. 4) lift the torque rods 187 or 186 to forcibly rock the rotors in a plane parallel with the biaxial plane. The latter cylinders are preferably mounted vertically. The terminal clevis 166 on ram 165, for example, is directly pivoted to the end of torque rod 187. Thus a rocking movement in the direction of arrows 169A, 169B is established. Blade pitch control cylinders 200, 200A are also mounted vertically. These change blade pitch by moving the forks 176 (FIG. 1), producing displacements as illustrated by arrows 178 (FIG. 4). Trowel blade pitch control is thoroughly discussed in the previously cited patent documents.

Figure 5:
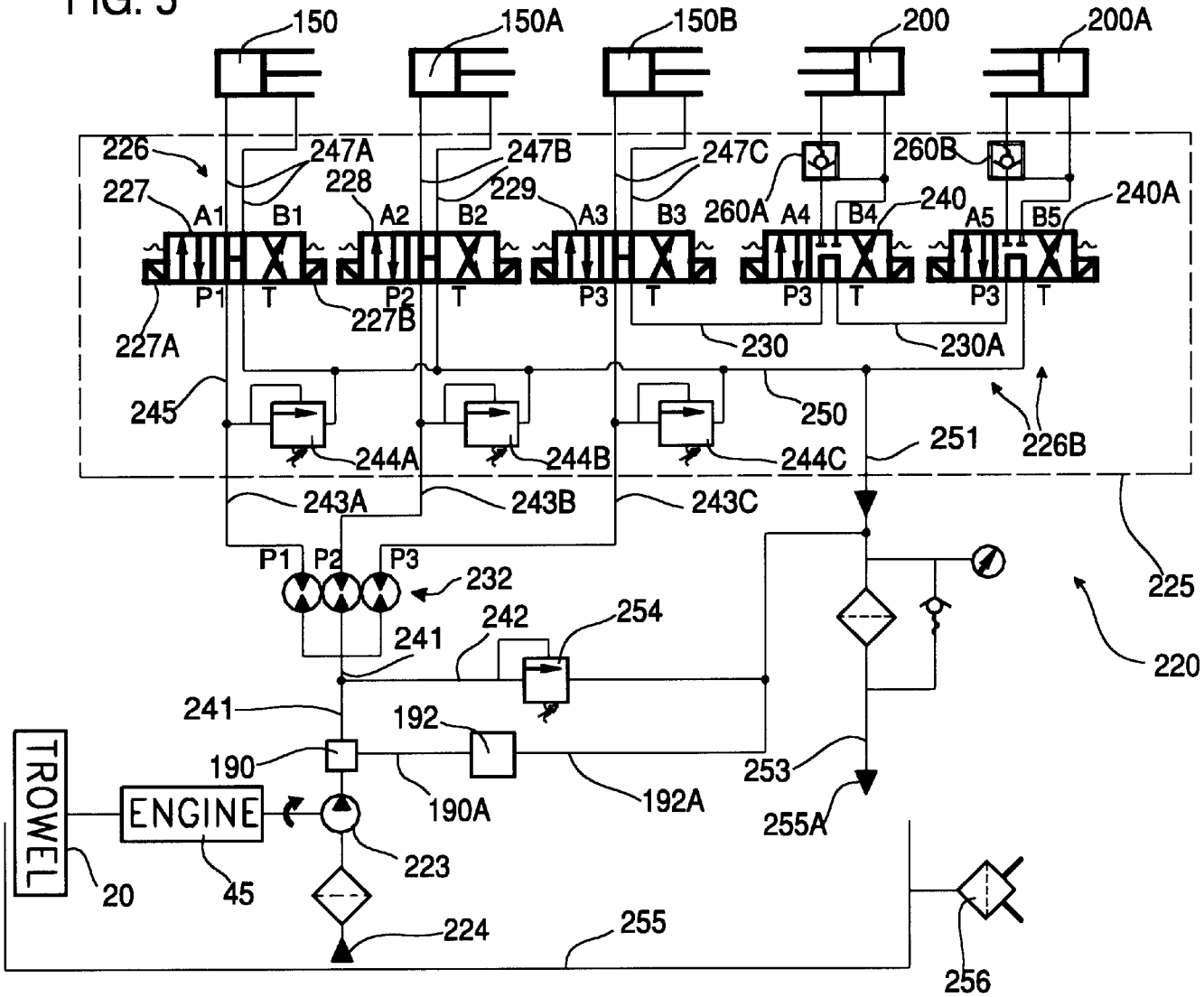
FIG. 5 is a schematic diagram of the preferred hydraulics.
Figure 6:
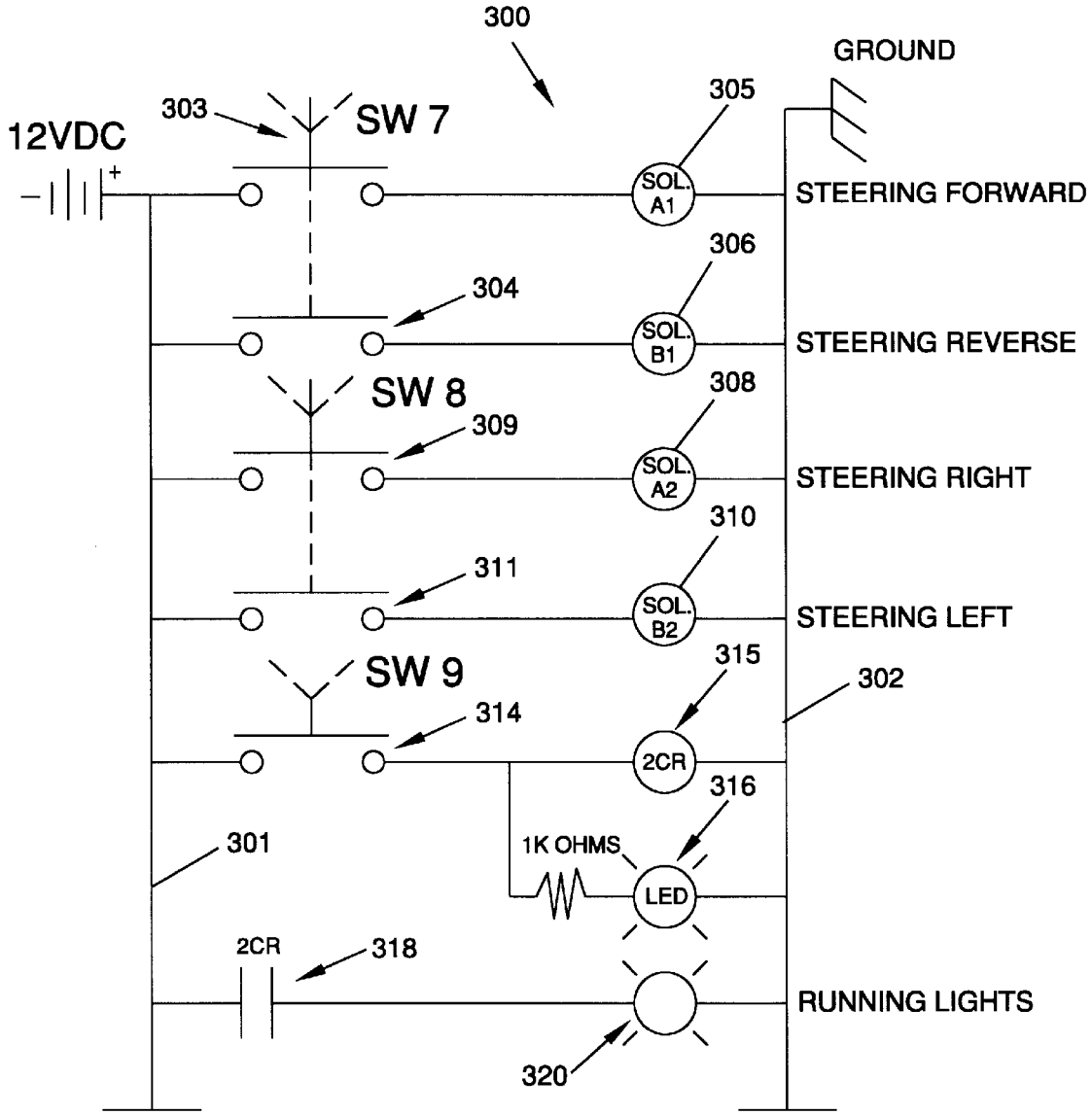
FIG. 6 is an electrical schematic of the right hand joystick control circuit; and, FIG. 7 is an electrical schematic of the left hand joystick control circuit.

Referring now to FIG. 5, the preferred hydraulic circuit 220 comprises a hydraulic pump 223 driven by a engine 45. The pump circulates fluid stored in reservoir 255, sectioning through the circuitry as indicated by arrowhead 224. Pump output reaches T-fitting 190 coupled to variable bypass needle valve 192 via passage 190A. Valve 192 is adjustable, and it is preferably mechanically located on the top of the trowel on cabinet 75A adjacent the driver so he can adjust his steering response speed (FIG. 1). The valve 192 drains through line 192A to the hydraulic return. The hydraulic flow rate and load experienced by the trowel depends upon numerous factors including the type of blade or pans chosen, the weight of the operator, and the hardness of the concrete being treated. Valve 192 provides a convenient means for the driver to quickly adapt flow rates to his operating conditions. It is preferred that this bypass valve be plumbed in immediately after the pump and before the flow dividers.

The main solenoid control valves are arranged in a manifold identified schematically by the reference numeral 225 that comprises steering valve banks 226 is and blade pitch bank 226B. Steering bank 226 is ultimately pressured through line 241 outputted from T-fitting 190 and lines 243A, 243B and 243C from the flow divider. Bank 226B, responsible for blade pitch, is connected to the "T" port of valve 229 on line 230. The pitch control solenoid valves 240 and 240A in bank 227 are interconnected by flow lines 230 and 230A.

Bank 226 comprises a plurality of four way, three position, solenoid-actuated hydraulic valves 227, 228, and 229. The "T" ports are tied together. These valves are respectively connected to tilting cylinders 150 (i.e., FIGS. 4, 5), 150A, and 150B. For example, ports A1 and B1 of valve 227 control cylinder 150.

Pitch control bank 226B comprises solenoid activated hydraulic valves 240 and 240A. These respectively actuate pitch control pistons 200 and 200A (FIGS. 4, 5), associated with the rotors. Ports A4 and B4 of valve 240, for example, control left pitch control cylinder 200. When activated, they control blade pitch by hydraulically deflecting the pitch control fork.

Pump 223 (FIG. 5) transmits through line 241 to flow divider 232 (FIG. 5) that divides the hydraulic output into three equal flows. Flow from section one of divider 232 appears on line 243A and reaches cartridge relief valve 244A and port P1 of the four way valve 227 via line 245. Solenoid 227A establishes normal flow; solenoid 227B reverses the flow across ports A1 and B1. Similarly, the flow from sections two and three of divider 232 outputted on lines 243B and 243C respectively reaches cartridge relief valves 244B, 244C and solenoid valves 228, 229. Relief valves 244A–244C are set to 450 P.S.I. in the best mode. Valves 228 and 229 have similar solenoids that are electrically energized to reverse flow across their output ports A2, B2 and A3, B3 respectively. The double acting cylinders 150A, 150B are thus extended or retracted. Each valve 227–229 has a pair of flexible lines 247A–247C respectively interconnecting its output ports to the tilting cylinders 150, 150A, and 150B respectively. Right side steering is primarily established by valve 228 and cylinder 150A. Right side forward/reverse control is primarily established by valve 227, that tilts cylinder 150. Left side forward/reverse control is primarily established by valve 229, that tilts cylinder 150B.

The circuit return is completed by lines 250, 251 and 253. The main relief valve 254 is coupled across the circuit by line 242; in the best mode it is set at 550 P.S.I. Return to reservoir 255 is indicated by arrowhead 255A. Reservoir 255 is vented by breather 256. Electrical control will be detailed hereinafter. Valves 227, 228, and 229 operate similarly. The absence of solenoid control signals establishes a neutral steering position; cylinder deflection to a neutral position occurs because of the weight borne by the rotor assemblies.

The pitch control bank 226B is powered through the third section of flow divider 232 and the T port of valve 229 on lines 230 and 230A. Valves 240 and 240A control cylinders 200 and 200A via their respective A and B ports. These valves have solenoids similar to solenoids 227A and 227B previously discussed. Pilot-operated check valves 260A and 260B hold the cylinders in position without drift.

Circuit 300 (FIG. 6) is operated by the right hand joystick 70. The right hand joystick 70 can be deflected between forward-neutral-reverse positions and left-neutral-right positions. The particular mechanical movement was selected for backwards compatibility with older twin rotor trowels; the joystick motions correspond generally with the mechanical hand-lever movements necessary for steering older twin rotor trowels.

In circuit 300 power (i.e., nominally 12 or 24 volts D.C.) is applied across lines 301 and 302. When the right joystick is moved forwardly, switch contacts 303 is close, activating solenoid field 305 that energizes solenoid 227A (FIG. 5) to pressure port Al of valve 227 for forward steering. Moving the right joystick rearwardly activates contacts 304 to energize solenoid field 306 and solenoid 227B (on valve 227), activating port B1 and reversing cylinder 150. Movement of the right joystick to the right activates solenoid field 308 through contacts 309 to activate port A2 on valve 228 for steering right. Similar movement of the right hand joystick to the left activates solenoid field 310 through contacts 311 for steering left; at this time port B2 on valve 228 is pressured. Push button switch 314 operates relay 315 and LED indicator 316; relay 315 closes switch contacts 318 to energize the running lights 320. Other electrical accessories can be powered in this fashion.

The left, single-axis joystick 75 can be deflected between forward, neutral, left and right and reverse selections. Again, the particular mechanical movement establishes backwards compatibility with older riding trowels. Blade pitch control switches are incorporated in the handle; there is a toggle control switch for pitch control of each rotor. The left hand joystick operates circuit 400 (FIG. 7).

Figure 7:
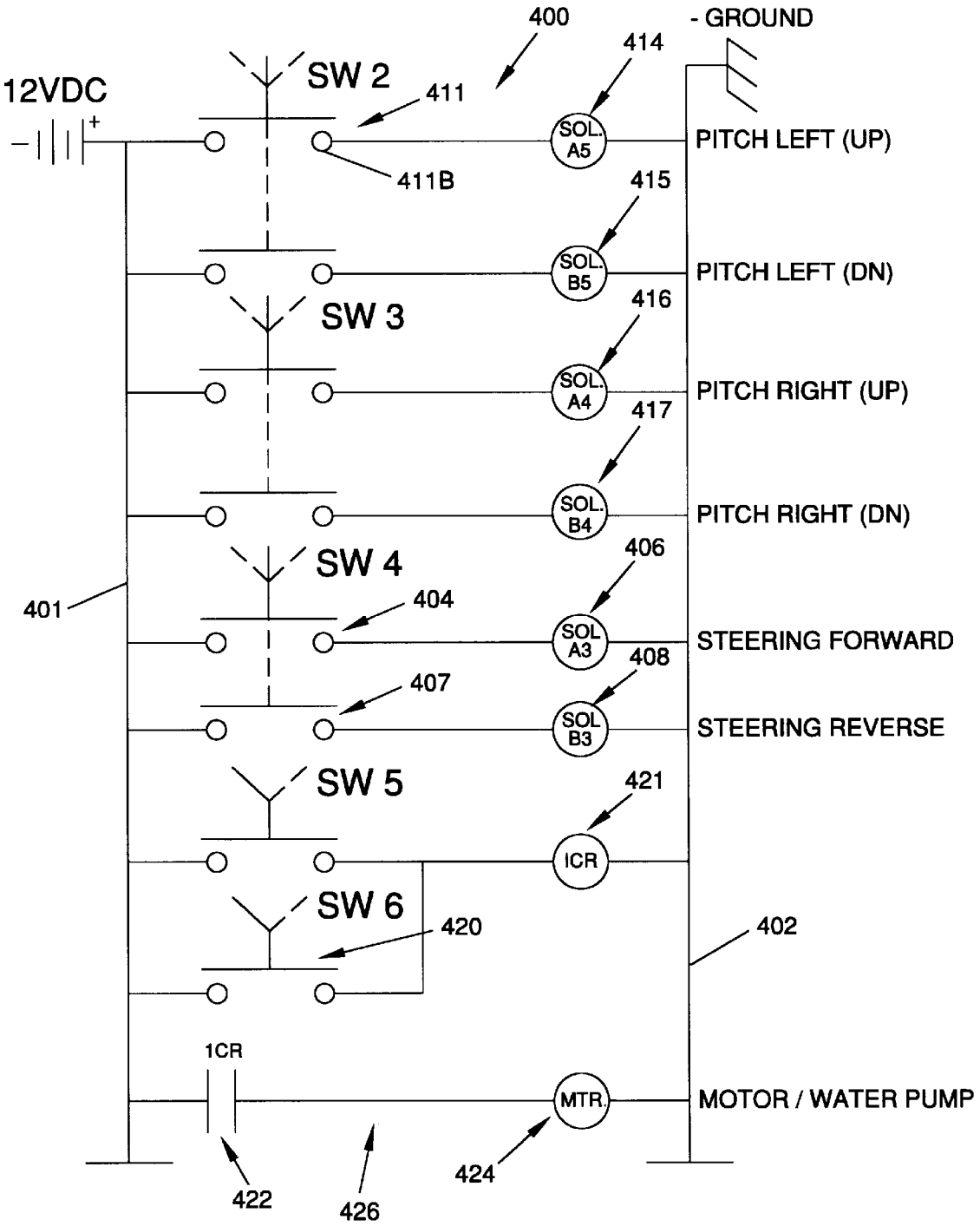

In circuit 400 source voltage is applied across lines 401, 402 (FIG. 7). When the left joystick is pushed forwardly (i.e., concurrently with the right joystick) to move the trowel forwardly, contacts 404 are closed to energize solenoid field 406. This activates port A3 of valve 229 (FIG. 5) and cylinder 150B. Pulling the left hand joystick rearwardly closes contacts 407 to energize solenoid field 408; this activates port B3 of valve 229 and retracts cylinder 150B.

To control blade pitch, single pole double throw toggle switches 411 are preferred (FIG. 5). When, for example, switch contacts 411B (FIG. 7) are closed to energize solenoid field 414, port A5 of valve 240A (FIG. 5) is activated to change blade pitch on the left rotor pitch control cylinder 200A. Solenoid fields 415–417 are similarly energized by the contacts and movements illustrated in FIG. 7. The respective solenoid valve "A" and "B" ports indicated in FIG. 5 correspond to the labeled ports in FIG. 7. Switch contacts 420 activate relay field 421 to close relay contacts 422, energizing an optional spray pump motor 424.

Operation

In operation a variety of operator precautions must be observed, as is the case with prior art motorized trowels. The hydraulic tanks should be periodically inspected for proper level, and the rotor blades must be changed as necessary after routine inspections for wear. Fuel tank levels must be sufficient for extended periods of use. During the initial finishing of wet concrete, proper pans will first be installed on the rotors by coupling the rotor blades to the radially spaced apart brackets provided.

If pressure is applied to the inside of the left and right rotors by tilting them appropriately with the double acting cylinders, then the machine will move in reverse. This occurs when the joysticks are pulled rearwardly. To move left, with the rear rotors untilted (i.e., neutral) subsequent tilting of the right rotor by hydraulic cylinder 150 will cause the trowel to make a left hand, wide sweeping turn. With the rotors untilted in the biaxial plane (i.e., neutral) tilting of the front rotor to concentrate pressure at its rear (i.e., towards the interior of the riding trowel frame) will cause the trowel to make a right hand, wide sweeping turn. At this time the right hand joystick is moved to the right.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A motorized, twin rotor riding trowel comprising:

a frame;

two rotor assemblies pivoted to said frame for finishing a concrete surface, each rotor assembly comprising a plurality of blades of variable pitch and each rotor assembly comprising an axis of rotation, both axes lying in a biaxial plane generally perpendicular to said surface;

internal combustion motor means for powering the trowel;

a source of hydraulic pressure driven by said motor means;

first cylinder means linked to said frame and extending to said rotor assemblies for tilting said rotor assemblies in a plane parallel to or coplanar with the biaxial plane to effectuate steering and propulsion;

second cylinder means linked to said frame and extending to one of said rotor assemblies for tilting it in a plane perpendicular to the biaxial plane to aid steering and propulsion;

joystick means comprising separate left and right joysticks accessible to the trowel operator for operating said first cylinder means and said second cylinder means, whereby the operator of the trowel can steer and control it hydraulically.

2. The trowel as defined in claim 1 further comprising pitch control cylinder means for varying rotor assembly blade pitch and pitch control valve means for controlling said pitch control cylinder means in response to said joystick means.

3. The trowel as defined in claim 1 further comprising:

first tilting valve means for controlling said first cylinder means;

first circuit means for electrically activating said first tilting valve means in response to said joystick means;

second tilting valve means for controlling said second cylinder means; and, second circuit means for electrically activating said second tilting valve means in response to said joystick means.

4. The trowel as defined in claim 2 further comprising first circuit means for electrically activating said first valve means in response to said joystick means and second circuit means for electrically activating said second valve means in response to said joystick means.

5. The trowel as defined in claim 4 further comprising operator accessible adjustable valve means for controlling hydraulic flow.

6. A motorized twin-rotor riding trowel comprising:

a frame;

two rotor assemblies pivoted to said frame for finishing a concrete surface, each rotor assembly comprising a plurality of blades of variable pitch, and each rotor assembly establishing an axis of rotation, both axes lying in a biaxial plane generally perpendicular to said surface;

internal combustion motor means for powering the trowel by rotating the rotor assemblies;

a source of hydraulic pressure driven by said motor means;

hydraulic circuit means for controlling the trowel, said hydraulic circuit means comprising:

first cylinder means linked to said frame and extending to said rotor assemblies for tilting said rotor assemblies in a plane generally parallel with the biaxial plane to effectuate propulsion and steering;

first valve means for controlling said first cylinder means;

second cylinder means linked to said frame and extending to one of said rotor assemblies for tilting it in a plane generally perpendicular to the biaxial plane to aid steering;

second valve means for controlling said second cylinder means; and, joystick means accessible to the trowel operator for operating said first valve means and said second valve means, whereby the operator of the trowel can steer and control the trowel hydraulically.

7. The trowel as defined in claim 6 wherein said hydraulic circuit means further comprises blade pitch control cylinder means for varying rotor assembly blade pitch and pitch valve means for controlling said blade pitch control cylinder means in response to said joystick means.

8. The trowel as defined in claim 7 further comprising tilt control electrical circuit means for electrically activating said first valve means second valve means in response to said joystick means and blade pitch control electrical circuit means for electrically activating said blade pitch valve means in response to said joystick means.

9. The trowel as defined in claim 8 wherein said hydraulic circuit means further comprises operator accessible adjustable valve means for controlling hydraulic flow to facilitate custom operator adjustments to trowel steering and control.

10. The trowel is defined in claim 8 wherein said hydraulic circuit means further comprises a motor driven pump, flow divider means transmitting fluid to said first and second cylinder means, and operator adjustable flow valve means for bypassing fluid prior to delivery to said flow divider means to facilitate custom operator adjustments to trowel steering and control.

11. A motorized electric-over-hydraulic, twin rotor riding trowel for finishing a concrete surface, said riding trowel comprising:

a rigid frame;

a pair of spaced apart rotor assemblies for frictionally contacting and finishing said concrete surface, the rotor assemblies mounted to said frame, each rotor assembly comprising a plurality of radially spaced apart blades for frictionally contacting the concrete being finished;

internal combustion motor means for powering the trowel by rotating the rotor assemblies;

cylinder means for selectively tilting said rotor assemblies for steering;

solenoid valve means for operating said cylinder means;

electrical circuit means for operating said solenoid valve means; and, joystick means for selectively activating said electrical circuit means.

12. A self-propelled, motorized riding trowel for finishing a concrete surface, said riding trowel comprising:

a frame adapted to be disposed over said concrete surface;

a pair of spaced apart rotors suspended from said frame for propelling said riding trowel, said rotors frictionally contacting and finishing said concrete surface and supporting said trowel above it;

a seat on said frame for supporting an operator of said riding trowel;

hydraulic circuit means for controlling the trowel, said hydraulic circuit means comprising:

a pump for supplying hydraulic fluid under pressure;

cylinder means linked to said frame and extending to said rotors for tilting the rotors to effectuate steering;

valve means for controlling said cylinder means;

flow divider means transmitting fluid to said cylinder means; and, operator adjustable flow valve means for bypassing fluid prior to delivery to said flow divider means to facilitate custom operator adjustments to trowel steering and control; and, joystick means accessible to the trowel operator for operating said valve means, whereby the operator of the trowel can steer and control it hydraulically.

13. A self-propelled, riding trowel for finishing a concrete surface, said riding trowel comprising:

seat means for supporting an operator of said riding trowel;

joystick means accessible by said operator from said seat means for steering said riding trowel;

rigid frame means adapted to be disposed over said concrete surface for supporting said seat means and said joystick means;

a pair of spaced-apart rotors suspended from said frame means, each rotor comprising a plurality of blades for frictionally contacting said concrete surface and each rotor having an axis of rotation, both axes lying in a biaxial plane generally perpendicular to said surface;

gearbox means for driving each rotor;

motor means for driving said gearbox means to power said riding trowel;

drive shaft means for actuating said gearbox means in response to said motor means thereby revolving said rotor means;

torque rod means extending to said gearbox means for tilting each of said rotors in a plane generally parallel with said biaxial plane; and, hydraulic circuit means for controlling the trowel, said hydraulic circuit means comprising first cylinder means for actuating said torque rod means in response to said joystick means and second cylinder means for tilting at least one of said rotors in a plane generally perpendicular to said biaxial plane in response to at least one of said joystick means to effectuate steering and control.

14. The trowel as defined in claim 13 wherein said hydraulic circuit means further comprises pitch control cylinder means for varying rotor blade pitch and pitch control valve means for controlling said pitch control cylinder means in response to said joystick means.

15. The trowel as defined in claim 13 further comprising first electrical circuit means for electrically activating said first cylinder means in response to said joystick means and second electrical circuit means for electrically activating said second cylinder means in response to said joystick means.

16. The trowel as defined in claim 13 wherein said hydraulic circuit means further comprises operator accessible adjustable valve means for controlling hydraulic flow to facilitate custom operator adjustments to trowel steering and control.

17. The trowel as defined in claim 13 wherein said hydraulic circuit means further comprises a motor driven pump, flow divider means transmitting fluid to said first and second cylinder means, and operator adjustable flow valve means for bypassing fluid prior to delivery to said flow divider means to facilitate custom operator is adjustments to trowel steering and control.

18. The trowel as defined in claim 13 wherein said hydraulic circuit means further comprises:

pitch control cylinder means for varying rotor blade pitch;

pitch control valve means for controlling said pitch control cylinder means in response to said joystick means;

a motor driven pump;

flow divider means transmitting fluid to said first and second and pitch control cylinder means; and, operator adjustable flow valve means for bypassing fluid prior to delivery to said flow divider means to facilitate custom operator adjustments to trowel steering and control.

19. For a self-propelled, riding trowel of the type comprising a frame, internal combustion engine means secured to said frame, and a pair of spaced part, revolving, bladed, rotor assemblies tiltably suspended from said frame and driven by said engine means, a power steering system comprising:

pump means driven by said internal Combustion engine means for supplying hydraulic pressure;

hydraulic circuit means powered by said pump means for operating the power steering system, said circuit means comprising:

tilting cylinder means for tilting the rotor assemblies to effectuate trowel steering and maneuvering;

valve means for controlling said tilting cylinder means;

left and right joysticks accessible to a trowel operator for operating said valve means whereby the operator of the trowel can steer and control the riding trowel hydraulically; and, wherein the left and right joysticks move generally with the same mechanical hand-lever movements necessary for steering older manual steering riding trowels thereby establishing backwards compatibility.

20. For a self-propelled, riding trowel of the type comprising a frame, internal combustion engine means secured to said frame, and a pair of spaced part, revolving, bladed, rotor assemblies tiltably suspended from said frame and driven by said engine means, a power steering system comprising:

pump means driven by said internal combustion engine means for supplying hydraulic pressure;

hydraulic circuit means powered by said pump means for operating the power steering system, said circuit means comprising:

tilting cylinder means for tilting the rotor assemblies to effectuate trowel steering and maneuvering;

valve means for controlling said tilting cylinder means; and, left and right joysticks accessible to a trowel operator for operating said valve means whereby the operator of the trowel can steer and control the riding trowel hydraulically; and, operator adjustable flow valve means for bypassing fluid prior to delivery to said hydraulic circuit means to facilitate custom operator adjustments to trowel steering and control.

21. For a self-propelled, riding trowel of the type comprising a frame, internal combustion engine means secured to said frame, and a pair of spaced part, revolving, bladed, rotor assemblies tiltably suspended from said frame and driven by said engine means, a power steering system comprising:

pump means driven by said internal combustion engine means for supplying hydraulic pressure;

hydraulic circuit means powered by said pump means for operating the power steering system, said circuit means comprising:

tilting cylinder means for tilting the rotor assemblies to effectuate trowel steering and maneuvering;

valve means for controlling said tilting cylinder means;

electric circuit means for controlling said valve means;

left and right joysticks accessible to a trowel operator for operating said electric circuit means whereby the operator of the trowel can steer and control the riding trowel hydraulically; and, operator adjustable flow valve means for bypassing fluid prior to delivery to said hydraulic circuit means to facilitate custom operator adjustments to trowel steering and control; and, wherein the left and right joysticks move generally with the same mechanical hand-lever movements necessary for steering older manual steering riding trowels thereby establishing backwards compatibility.

22. A motorized, twin-rotor riding trowel for finishing a concrete surface, said riding trowel comprising:

a rigid frame;

internal combustion motor means for powering said trowel;

hydraulic pump means driven by said motor means for supplying hydraulic pressure;

a pair of spaced apart rotors pivotally suspended from said frame for supporting and propelling said riding trowel and finishing said concrete, each rotor comprising a plurality of radially spaced apart blades for frictionally contacting the concrete;

hydraulic circuit means powered by said pump means for power steering the trowel, said circuit means comprising:

tilting cylinder means for tilting the rotors to effectuate trowel steering and maneuvering;

valve means for controlling said tilting cylinder means; and, left and right joysticks accessible to a trowel operator for operating said valve means whereby the operator of the trowel can steer and control the riding trowel hydraulically; and, operator adjustable flow valve means for bypassing fluid prior to delivery to said hydraulic circuit means to facilitate custom operator adjustments to trowel steering and control.

23. A motorized, twin-rotor riding trowel for finishing a concrete surface, said riding trowel comprising:

a rigid frame;

internal combustion motor means for powering said trowel;

hydraulic pump means driven by said motor means for supplying hydraulic pressure;

a pair of spaced-apart rotors pivotally suspended from said frame for supporting and propelling said riding trowel and finishing said concrete, each rotor comprising a plurality of radially spaced apart blades for frictionally contacting the concrete;

hydraulic circuit means powered by said pump means for power steering the trowel, said circuit means comprising:

tilting cylinder means for tilting the rotors to effectuate trowel steering and maneuvering;

valve means for controlling said tilting cylinder means; and, electric circuit means for controlling said valve means;

left and right joysticks accessible to a trowel operator for operating said electric circuit means whereby the operator of the trowel can steer and control the riding trowel hydraulically;

operator adjustable flow valve means for bypassing fluid prior to delivery to said hydraulic circuit means to facilitate custom operator adjustments to trowel steering and control; and, wherein the left and right joysticks move generally with the same mechanical hand-lever movements necessary for steering manual steering riding trowels thereby establishing backwards compatibility.

24. A motorized riding trowel for finishing a concrete surface, said riding trowel comprising:

a rigid frame;

internal combustion motor means supported by said frame for powering said trowel;

a pair of spaced-apart rotor assemblies pivotally suspended from said frame for supporting and propelling said riding trowel and finishing said concrete, each rotor assembly comprising a plurality of radially spaced apart blades for frictionally contacting the concrete;

electric over hydraulic power steering means for controlling trowel steering and maneuvering, said power steering means comprising:

hydraulic pump means driven by said internal combustion motor means for supplying hydraulic pressure;

tilting cylinder means for tilting the rotor assemblies to effectuate trowel steering and maneuvering;

hydraulic circuit means powered by said pump means for operating the tilting cylinder means, said hydraulic circuit means comprising solenoid valve means for hydraulically pressuring the tilting cylinder means in response to electric signals;

electric circuit means for selectively outputting said electric signals; and, left and right joysticks accessible to a trowel operator for operating said electric circuit means whereby the operator of the trowel can steer and control the riding trowel electro-hydraulically.

25. A motorized riding trowel for finishing a concrete surface, said riding trowel comprising:

a rigid, generally rectangular frame having a left and a right side;

a left rotor assembly and a spaced apart right rotor assembly for propelling said riding trowel and frictionally contacting said concrete, each rotor assembly comprising a plurality of radially spaced apart blades for frictionally contacting the concrete being finished;

internal combustion motor means supported by said frame for powering said trowel;

electric over hydraulic power steering means for controlling trowel steering and maneuvering, said power steering means comprising:

hydraulic pump means driven by said internal combustion motor means for supplying hydraulic pressure;

a pair of tilting cylinders for tilting the left and the right rotor assemblies in a plane parallel with a biaxial plane established by the axis of rotation of said left and right rotor assemblies, and another tilting cylinder for tilting at least one of said left and right rotor assemblies in a plane perpendicular to said biaxial plane, whereby to effectuate trowel steering and maneuvering;

hydraulic circuit means powered by said pump means for operating the tilting cylinders in response to electric signals, said hydraulic circuit means comprising a bank of tilting solenoid valves, one solenoid valve associated with each tilting cylinder;

electric circuit means for selectively outputting said electric signals; and, left and right joysticks accessible to a trowel operator for operating said electric circuit means whereby the operator of the trowel can steer and control the riding trowel electro-hydraulically.

26. The trowel as defined in claim 25, wherein said hydraulic circuit means comprises flow divider means for independently pressuring each tilting solenoid valve; and, operator adjustable flow valve means for bypassing fluid prior to delivery to said flow divider means to facilitate custom operator adjustments to trowel steering and control.

* * * * *